US005485780A

United States Patent [19]

Koether et al.

[11] Patent Number: 5,485,780

[45] Date of Patent: Jan. 23, 1996

[54] ROTISSERIE OVEN

[75] Inventors: Bernard Koether, Tequesta, Fla.; George F. Koether, II, Bridgeport, Conn.; Harald Ubert, Raesfeld, Germany

[73] Assignee: Food Automation Service Techniques, Inc., Stratford, Conn.

[21] Appl. No.: 23,949

[22] Filed: Feb. 26, 1993

[51] Int. Cl.[6] ..... A47J 37/04

[52] U.S. Cl. ..... 99/419; 99/421 H; 219/400

[58] Field of Search ..... 99/419, 476, 421 H, 99/421 HH, 401, 447, 421 R, 446, 341; 126/214; 219/400, 757

[56] References Cited

U.S. PATENT DOCUMENTS

| | | | |
|---|---|---|---|
| 2,600,760 | 6/1952 | Guffey | 99/421 |
| 2,809,579 | 10/1957 | Theisen | 99/339 |
| 2,969,450 | 1/1961 | Bernstein | 219/35 |
| 3,263,593 | 8/1966 | Appleman | 99/324 |
| 3,273,489 | 9/1966 | Wilson | 99/421 |
| 3,485,229 | 12/1969 | Gilliom | 126/21 |
| 3,783,219 | 1/1974 | Tateda | 219/757 |
| 3,827,345 | 8/1974 | Willson | 99/325 |
| 3,827,346 | 8/1974 | Tropp et al. | 99/446 |
| 4,132,216 | 1/1979 | Guibert | 219/400 X |
| 4,350,874 | 9/1982 | Nishikawa | 219/400 |
| 4,366,182 | 12/1982 | Köhler et al. | 426/644 |
| 4,409,452 | 10/1983 | Oochi et al. | 219/752 |
| 4,462,383 | 7/1984 | Henke et al. | 99/476 X |
| 4,469,019 | 9/1984 | Baer | 99/339 |
| 4,491,065 | 1/1985 | Poulson | 99/327 |
| 4,510,854 | 4/1985 | Robertson | 99/476 X |
| 4,561,348 | 12/1985 | Halters et al. | 99/412 H |
| 4,598,689 | 7/1986 | Eke | 126/21 A |
| 4,635,539 | 1/1987 | Tanaka | 99/421 H |
| 4,636,949 | 1/1987 | Longabaugh | 364/400 |
| 4,705,928 | 11/1987 | Nakanishi | 219/681 |
| 4,743,728 | 5/1988 | Nagafusa et al. | 219/757 |
| 4,763,638 | 8/1988 | Hurley et al. | 126/31 A |
| 4,824,644 | 4/1989 | Cox et al. | 422/300 |
| 4,829,158 | 5/1989 | Burnham | 219/400 |
| 4,865,864 | 9/1989 | Rijswijck | 219/400 X |
| 4,935,604 | 6/1990 | Allen et al. | 219/400 |
| 4,968,515 | 11/1990 | Burkett et al. | 426/233 |
| 5,044,262 | 9/1991 | Burkett et al. | 99/327 |
| 5,097,759 | 3/1992 | Vilgrain et al. | 99/483 |

FOREIGN PATENT DOCUMENTS

| | | |
|---|---|---|
| 0463657A1 | 5/1991 | European Pat. Off. . |

*Primary Examiner*—David Scherbel
*Assistant Examiner*—Patrick F. Brinson
*Attorney, Agent, or Firm*—Pennie & Edmonds

[57] ABSTRACT

A rotisserie oven including separate convection and radiant heating elements is provided with individually controllable fans to allow precise control of food quality during different operational modes of the oven. In particular, a cooling fan is provided which may be operated separately of convection fans to prevent unwanted air circulation within the oven. According to a further embodiment of the invention, the upper surface of the oven is provided with substantially flat and seam-free configuration to allow for easy cleaning. Channels provided for directed convection currents are easily removable to facilitate cleaning. A control system allows for selection of predetermined operational modes utilizing individual fan and heating element control.

14 Claims, 6 Drawing Sheets

ROTISSERIE OVEN

BACKGROUND OF THE INVENTION

The present invention relates to rotisserie ovens and, more particularly, to improvements in such ovens for increasing control of food quality and efficiency while using combinations of radiant and convection heat for cooking food therein.

Rotisserie ovens for grilling or otherwise cooking a variety of foods, such as meat or chicken, are well known in the art. Such ovens typically include an inner cooking chamber with a rotating spit or spits disposed therein for carrying the food. Also, typically provided are heating elements and one or more fans for circulating hot air within the oven to facilitate convection cooking. Radiant heating elements may also be provided for searing or holding the temperature of the food in the oven.

Two representative prior art commercial-type rotisserie ovens are disclosed in U.S. Pat. No. 4,561,348 to Halters et al. and U.S. Pat. No. 4,968,515 to Burkett et al. Although these represent improvements in prior rotisserie ovens, the present generation of rotisserie ovens still experience problems such as poor fan motor life due to clogging with grease, difficulty in cleaning the oven interior and difficulty in controlling or holding the temperature of the food product being cooked after the cooking is complete.

Burkett et al. attempt to address the problem of holding the cooked food product after cooking without lowering the quality, particularly by drying. For this purpose, Burkett et al. disclose a control system which pulses a circulation fan on and off, depending on the internal oven temperature.

However, neither Burkett et al., Halters et al. nor the present generation of commercially available rotisseries address a problem frequently presented in commercial applications wherein it may be desirable to heat the food product by radiant heat alone, for holding or other cooking purposes, without circulating hot air within the oven. This problem is particularly encountered in the Halters et al. oven and is typical of the prior art. For example, once the food product being cooked has reached the desired degree of doneness, it is desirable to reduce or even stop the circulation of hot air within the oven in order to reduce or stop the cooking of the food product. However, when the inside fan is stopped to prevent further cooking of the food product, the outside or cooling circulation fan also stops, thus stopping air flow which cools both the fan motor and the shell of the oven. For this reason, safety regulations require at least 6 inches of space surrounding ovens made according to the Halters et al. design. If the fan is operated to continue the cooling, the extra circulation of hot air within the oven tends to overcook or dry out the food product. While Burkett et al. attempt to solve the problem of food product dryness, its solution does not provide benefits in all applications.

Another problem with the prior art ovens has been difficulty in cleaning. Although the Halters et al. oven is intended to reduce the splatter of grease within the oven, a degree of splattering still occurs and the oven must be cleaned regularly. The configuration of the inside top of the Halters et al. oven is typical of convection ovens in that it provides a plurality of heating elements and air flow spaces for heating the convection currents. It is also typical in that it presents a fairly complex surface which is difficult to clean. There is, therefore, a need in the art for convection-type rotisserie oven which provides necessary air flow spaces and heating elements, while also providing an easy to clean and maintain surface.

SUMMARY OF THE INVENTION

It is therefore an object of the present invention to provide a rotisserie oven capable of individual infrared light, convection and radiant cooking and any combination thereof which provides a high degree of controllability for the food product being cooked.

It is a further object of the present invention to provide a commercial-quality rotisserie oven which is easily cleaned and maintained.

Another object of the invention is to provide means for altering the convection properties of the oven to accommodate different food products and cooking requirements.

Yet another object of the invention is to provide a control system for controlling the oven of the present invention in a plurality of cooking modes.

These and other objects according to the present invention are achieved by an oven comprising a cooking chamber for receiving food products to be cooked, an outer casing surrounding the cooking chamber and a plurality of airflow passages defined thereby. The cooking chamber is defined at least by side walls and top and bottom walls. The outer casing is spaced away from the cooking chamber to define circulation passages between the chamber side and top walls and the casing. A first airflow passage is disposed within the cooking chamber and defined by the top wall of the chamber and a removable cover secured thereto. Removable fastening means are used to secure the cover for easy removal for cleaning and to allow interchangeability with covers providing different convection air flow properties. The first fan means is disposed within the first airflow passage to draw air therethrough and circulate it within the cooking chamber. Means are disposed within the first airflow passage for heating air passing therethrough.

In a preferred embodiment of the present invention, the top wall of the cooking chamber is substantially flat and substantially without seams in the area of the first airflow passage to provide easily cleanable surface. Preferably, the removable cover defines a rectangular cross-section for the first airflow passage and the first fan means is removably mounted within first passage to allow easy removal for easy cleaning.

According to a further preferred embodiment of the present invention, a second airflow passage is disposed above the cooking chamber and communicates with air outside the casing and with the circulation passages between the casing and chamber. Second fan means are disposed within the second passage for drawing air therein and circulating it through the circulation passages. The first and second fan means may be mounted on a common shaft which extends through the top wall of the cooking chamber and thus driven by a single fan motor disposed in the second airflow passage. According to a further preferred embodiment, the oven includes third fan means separately controllable from the first and second fan means. The third fan means is disposed to direct air from outside the oven into the second airflow passage for cooling the first fan motor and the oven casing without creating convection currents in the cooking chamber.

The present invention also may include rotisserie means for carrying food products to be cooked, such as a rotating spit. Preferably an electric motor is provided as means for rotating the rotisserie means. According to a further preferred embodiment, separate radiant heating means are mounted inside the cooking chamber, but outside the first air flow passage. The radiant heating means may comprise at least one electric heating element and at least one quartz lamp, each being separately controllable.

In a preferred embodiment, operator-interface means is provided to allow operator to select between a plurality of operational modes. Preferred modes include convection-only mode, radiant-only mode, infrared-only, combination mode and cool-down mode. The control means are responsive to the interface means for activating and controlling the heating elements and fan components in accordance with the operator-selected modes. Preferably, the rotisserie motor is also controlled by the control means to provide predetermined rotation speeds and times in response to the selected operational mode.

DETAILED DESCRIPTION OF THE PREFERRED EMBODIMENTS

Figure 1:
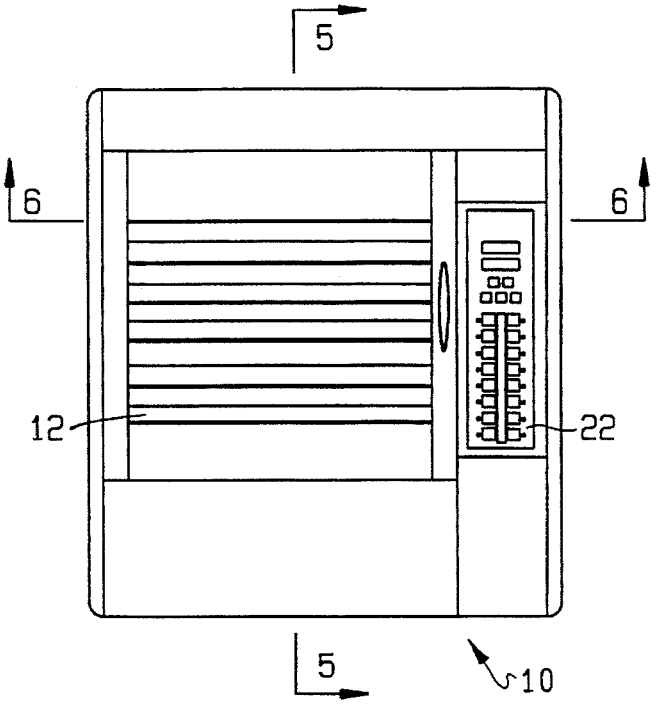
FIG. 1 is a front elevation of a rotisserie oven according to the present invention.
Figure 3:
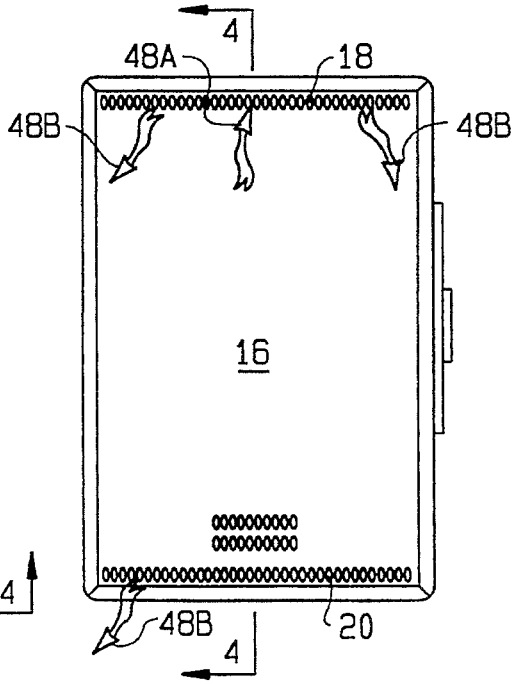
FIG. 3 is a left side elevation view of the oven of FIG. 1.
Figure 2:
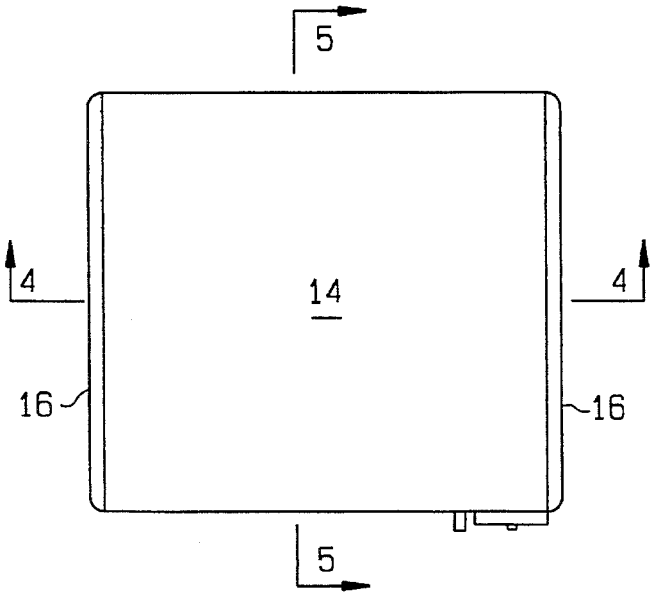
FIG. 2 is a top plan view of the oven of FIG. 1.

Referring first to FIGS. 1–3, the general arrangement of oven 10 according to the invention may be explained. Outwardly, oven 10 is constructed in a similar manner to prior art ovens, having glass door 12 on the front, with outer top panel 14 and side panels 16, the latter with vent holes 18 and 20. The oven also includes control panel 22 with a keypad and display, through which the operator controls the operation of the oven as explained below.

Figure 4:
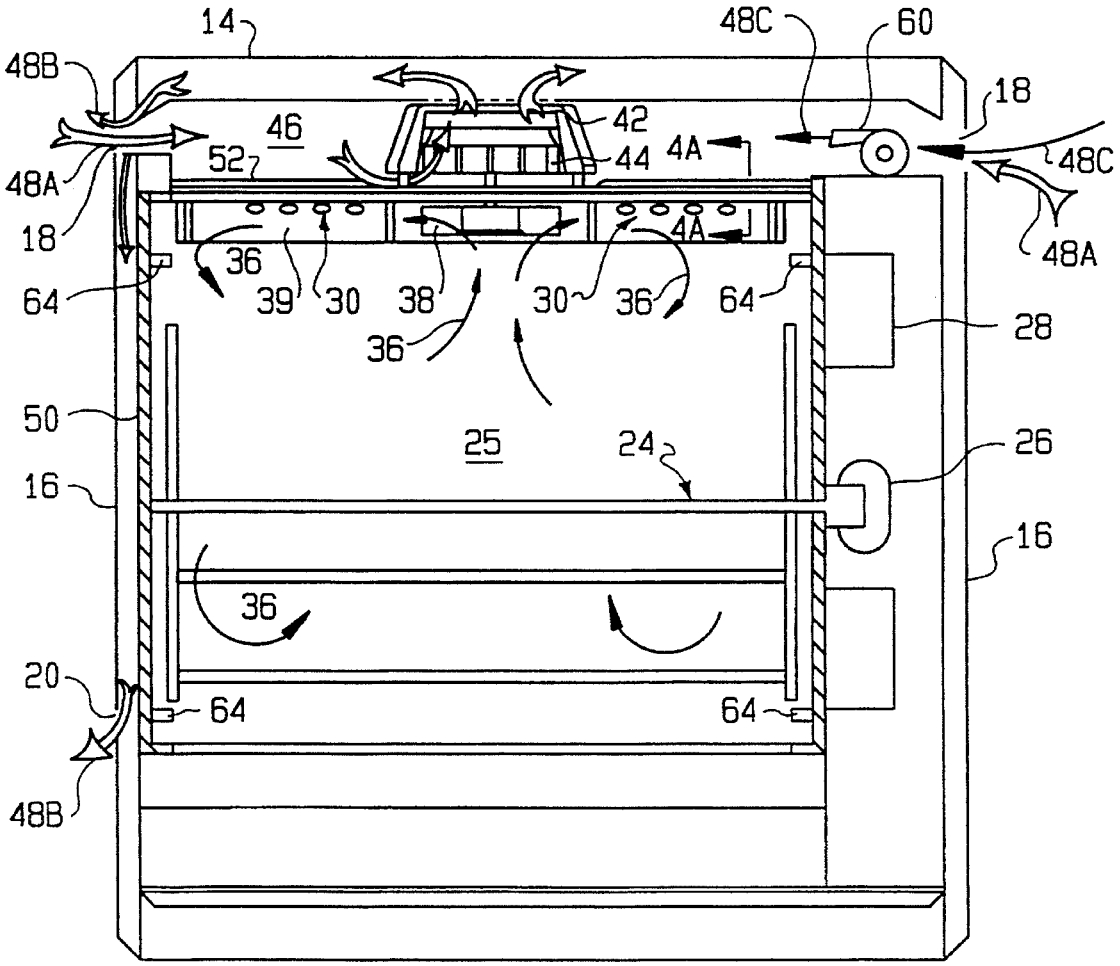
FIG. 4 is a section view through line 4—4 in FIGS. 2 and 3.

As shown in FIG. 4, oven 10 further comprises a spit arrangement 24 disposed in cooking chamber 25 and driven by motor 26. Motor 26 is mounted in an auxiliary space to the side of the oven, along with computer controller 28 and other associated electronics and wiring. Computer controller 28 controls the operation of motor 26 and the various heating means and fans described below in accordance with operator input through control panel 22. Motor 26 is preferably a capacitor start, sealed gear motor, air cooled with fractional horsepower, which are commercially available. A suitable controller is also commercially available under the name (FASTRON.)® from (FAST.)® Food Automation—Service Techniques, Inc. of Stratford, Conn. and may be programmed to operate in accordance with the various cooking and holding modes described herein.

Figure 6:
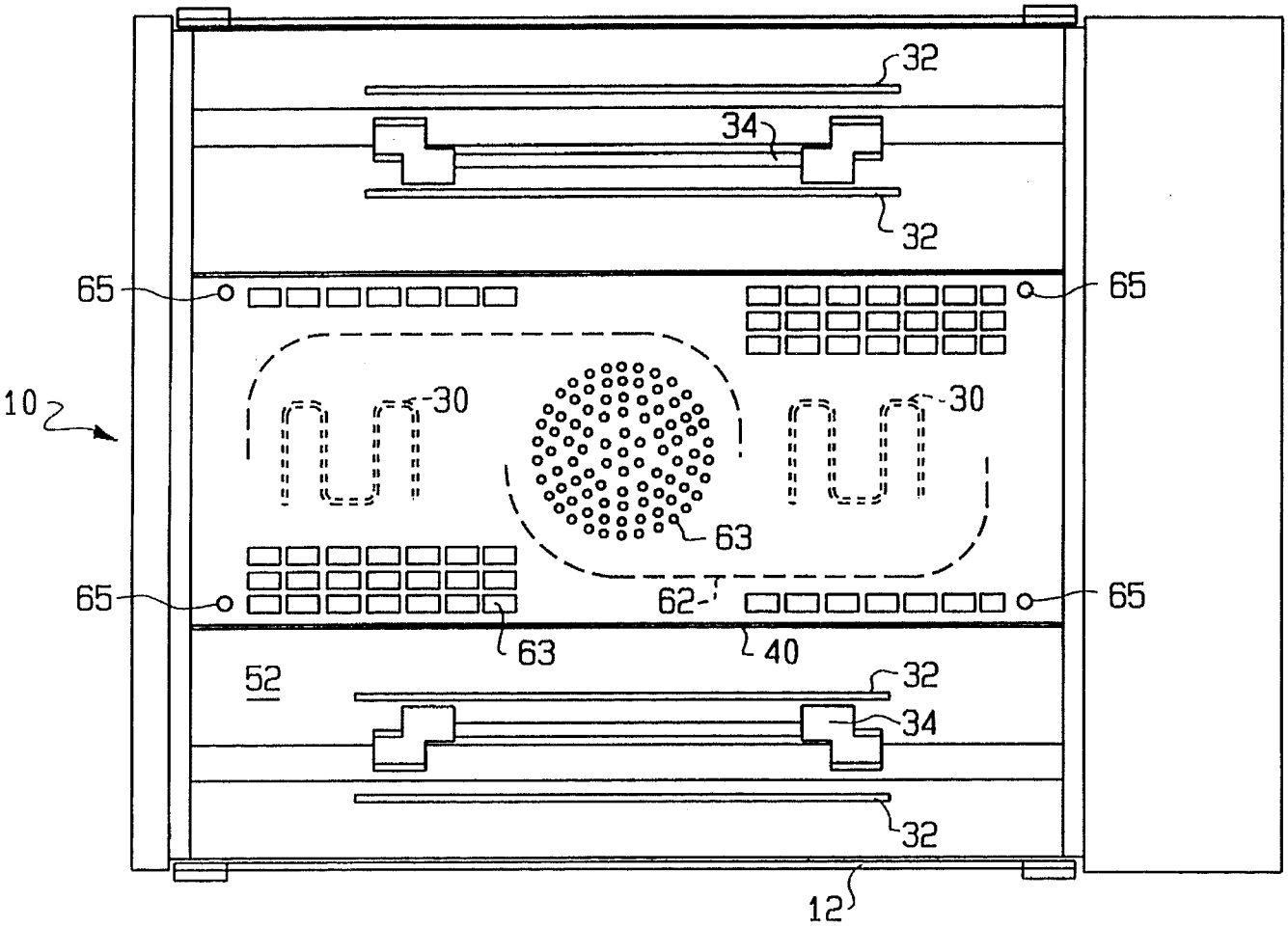
FIG. 6 is a section view through line 6—6 in FIGS. 1 and 3.

As best illustrated in FIG. 6, oven 10 includes at least three different heating means to provide a plurality of different operational modes. Electric elements 30 are positioned to heat air for convection cooking. Electric elements 32 are positioned to provide direct radiant heat to the food being cooked for radiant cooking or grilling. Heat lamps 34 also provide radiant heat commonly referred to in the art as infrared heat, particularly suitable for food holding modes, and light to display the food. Preferably, lamps 34 are quartz infrared lamps. Each of heating means 30, 32, and 34 are commercially available components and can be selected by a person of ordinary skill in the art depending upon factors such as oven capacity and food types to be cooked.

Figure 7:
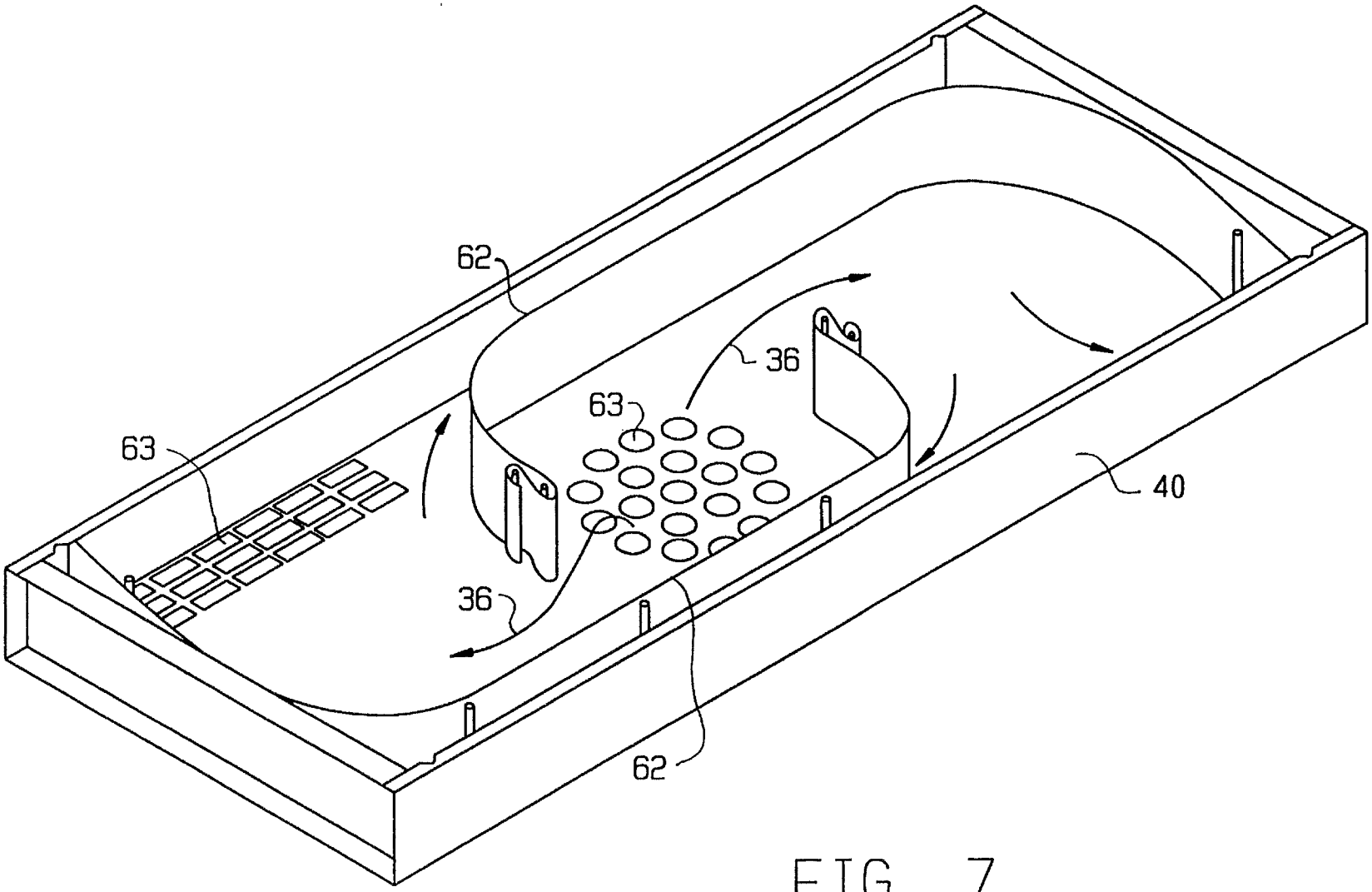
FIG. 7 is a perspective view of the inside channel cover of the invention.

Referring again to FIG. 4 and FIG. 5, two different air flow paths according to the invention may be seen. A first air flow path providing convection cooking is illustrated by arrows 36. Fan 38 draws air up into convection channel 39 through the center of convection channel cover 40 and around heating elements 30. The heated air is forced out of the convection channel formed by cover 40 and flows around spits 24 for convection cooking. The convection airflow can be varied by installing different covers as explained in more detail below with reference to FIG. 7. In a second air flow path, in order to cool both fan motor 42 and the oven walls, fan 44 draws air into central cooling channel 46 through the central portion of vents 18 (indicated by arrows 48A, see FIG. 3). Fan motor 42 is thus cooled, after which the air flows (indicated by arrows 48B) around the cooking chamber in the spaces between top panel 14 and side panels 16 and oven walls 50 and top 52 to cool the latter.

Figure 4A:
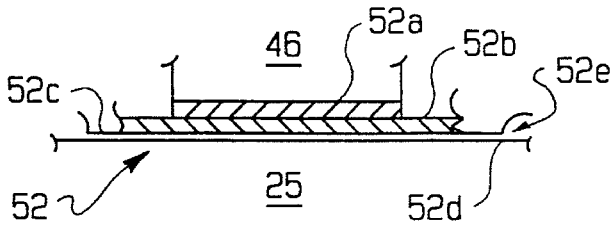
FIG. 4A is a section view through line 4A—4A in FIG. 4 showing a detail of the oven top insulation.

Convection air flow passage 39 and cooking chamber 25 are insulated from flow passage 46 and the rest of the oven top panel 14 to reduce heat loss and overheating of the outer surfaces. Oven walls 50 are also insulated. A preferred arrangement of insulation in top wall 52 is shown in FIG. 4A. A first layer of insulation 52*a* is provided in channel 46. This layer tapers away to create a recess for fan 44 and motor 42 (FIG. 4). A second layer of insulation 52*b* is provided over the entire oven top wall 52. Commercially available glass fiber batts provide effective insulation. Thicknesses of approximately ⅝ in. for layer 52*a* and ¾ in. for layer 52*b* have provided satisfactory results in tests. Depending on materials and temperatures, other thicknesses can be used. Two galvanized or otherwise protected sheet metal layers 52*c* and 52*d* make up the inner wall of top 52. These layers are bolted together at various locations, but not otherwise bonded or joined so as to create an almost imperceptible gap 52*e* therebetween. Gap 52*e* creates a conduction barrier between layers 52*c* and 52*d*, thus reducing heat transfer therethrough.

Figure 5:
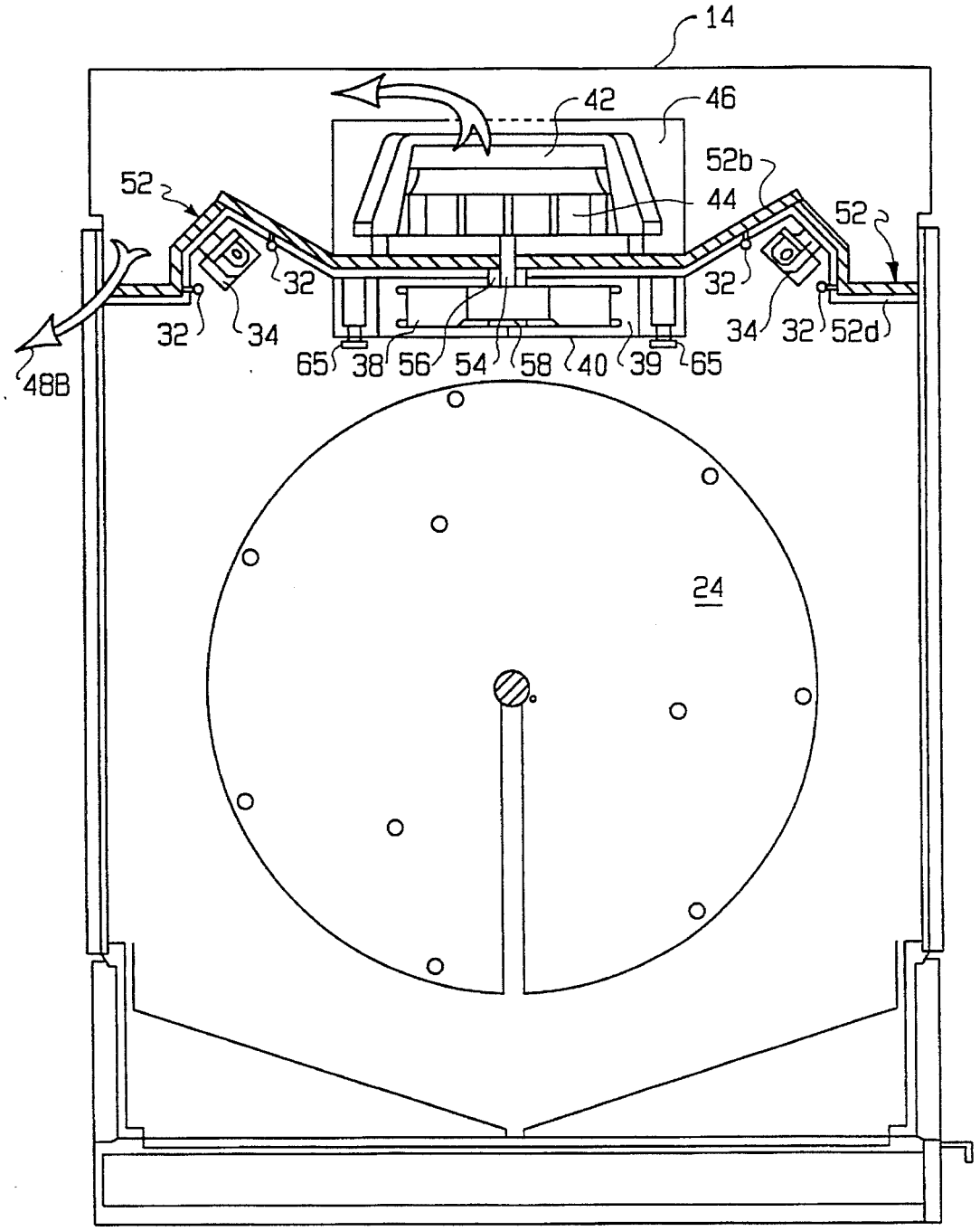
FIG. 5 is a section view through line 5—5 in FIGS. 1 and 2.

As can be seen best in FIG. 5, both fan 38 and fan 44 are impeller-type fans which are driven by motor 42 and mounted on common shaft 54. Shaft 54 extends through the oven top wall to drive fan 38 in convection channel 39. The air circulating in the convection channel during cooking has a large amount of grease entrained therein. In order to prevent grease from migrating up shaft 54 and damaging motor 42, a substantially grease-tight seal 56 is provided. Preferably, seal 56 is a non-grease permeable gasket, which is commercially available. Also, preferably, motor 42 is a semi-sealed, backward-curved impeller motor, also commercially available. Fan 38 is secured to shaft 54 by thumb screw 58 to allow easy removal of the fan during cleaning operations as explained below.

While the dual fan arrangement described readily provides for airflow and cooling during convection cooking modes, it does not provide cooling air flows during other modes, such as holding or radiant heat cooking. For this reason, according to the present invention, during non-convection modes fan 60 is activated to draw cooling air (indicated by arrows 48C) into central channel 46 through the upper, central, right side vents 18. The cooling air thus drawn into channel 46 follows the cooling path as described above to cool both the oven walls and top, and also fan motor 42 after it has be switched off.

By using only separate cooling fan 60 during holding and radiant cooking modes, hot air is not circulated inside the oven as a result of maintaining the necessary cooling air flows. Even though heating elements 30 may be turned off, it has been discovered that the circulation of air inside the oven, particularly during holding, in prior art ovens resulted in lack of control over the final product, particularly overdoneness and excessive dryness of the food. The present invention thus eliminates the prior art lack of control by providing a separate cooling fan for non-convection modes and also allows oven 10 to be used for a wider variety of foods and cooking modes because the application of radiant heat is not limited by either overheating concerns or lack of convection control.

Another problem with prior art rotisseries has been difficulty in cleaning. In the present invention, cleaning is simplified by the novel configuration of the inside top of the oven and particularly because the inside convection air flow channel is defined by cover 40 which is easily removable. Convection channel cover 40 is shown in detail in FIG. 7. The arrangement of baffles 62 and air vents 63 to provide for the convection air flow are clearly seen. Cover 40 is secured to oven top wall 52 by four thumb screws 65, two of which are shown in FIG. 5. Thumb screws 65 are easily removed by cleaning personnel to allow removal of cover 40 and provide a relatively smooth and unobstructed upper wall, as compared to prior art ovens, for easy cleaning. Alternatively, other quick release means, such as clips of rotating catches, can be used to secure the cover. Preferably the inside oven top is provided with a sealed seam construction. Cleaning is further simplified because fan 38 is mounted on shaft 54 by thumb screw 58, which is also readily removed by cleaning personnel. With these components removed, the top of the oven can be quickly and efficiently wiped clean.

Removable channel cover 40 provides a further advantage over prior art rotisserie ovens. With the oven according to the invention, the convection channel may be easily changed to accommodate different food products and cooking requirements. For example, by varying the size and number of air vents 63, the temperature and velocity of the convection flow can be varied. Reducing the number of air exit vents causes the air to stay in the channel longer, resulting in higher temperatures. Fewer exit vents also increases the velocity of the air flow exiting the convection channel. The correct configuration for different food products can be easily determined by persons of ordinary skill in the art.

Figure 8:
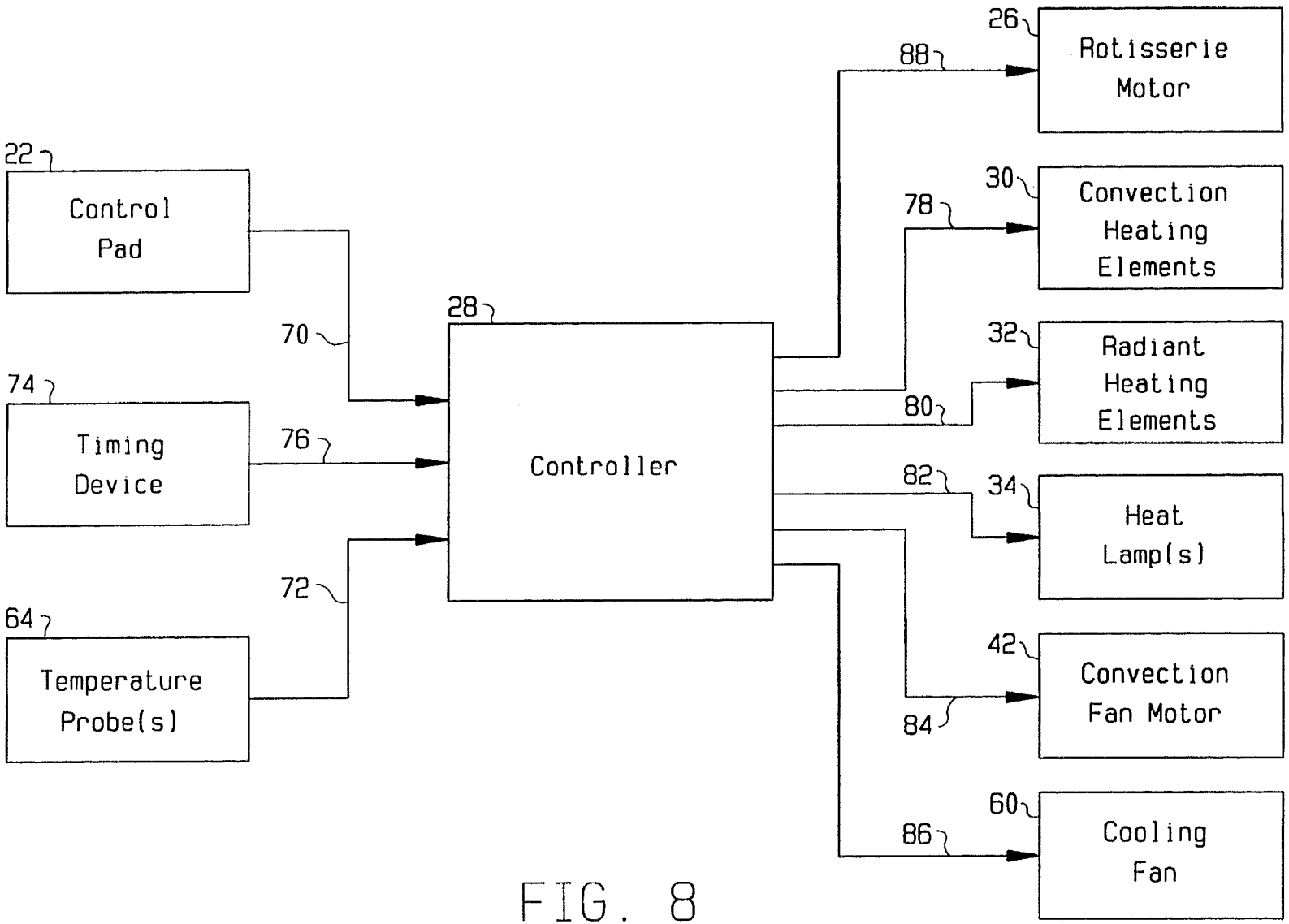
FIG. 8 is a block diagram illustrating a control system according to the present invention.

The provision of separate cooling fan 60, as well as the plurality of different heating means described above, allows for a greater variety of control modes in the present invention than was available in prior art rotisserie convection ovens. In particular, the present invention may include controllable radiant heat modes independent from convection modes. Prior art rotisserie ovens typically cycled convection and radiant heat simultaneously. The provision of independent cooling fan 60 and extra radiant heating elements 32, controlled by computer controller 28 as illustrated in FIG. 8, gives versatility to the operator for convection cooking or radiant grilling independently or together. Furthermore, by employing control systems such as disclosed in U.S. Pat. No. 4,920,948 to Koether et al., which is incorporated herein in its entirety by reference thereto, a large variety of operational modes including radiant and convection heat, as discussed above, as well as quartz infrared heat for light and holding, fan interaction and steam injection into the oven may be utilized.

In particular, control pad 22 is utilized as an operator interface to allow the operator to select between a plurality of predetermined operational modes stored in computer controller 28. Controller 28 thus activates and controls each fan and heating component in accordance with the selected operational mode. Examples of operational modes which take advantage of the novel features of the present invention are explained below. Also, operational modes may be combined to form predetermined cooking cycles for specific food types. In this manner, the operator need enter only the food type to be cooked and computer controller 28 will run the predetermined sequence of operational modes, each lasting for a specified time.

In a convection only mode, convection heating elements 30 and first and second fans 38, 42 are activated for convection only cooking of the food product. In this mode it would not be necessary to use the radiant heating elements 32, 34 or fan 60.

A variety of radiant heat only modes are possible with the present invention. For example, in a searing mode, radiant electric heating elements 32 are activated along with third fan 60, which cools the oven casing. In such a mode the heating elements are controlled by controller 28 to cook the food product substantially by radiant heat alone. Another radiant only mode is a holding mode or infrared-only mode wherein quartz lamps 34 and third fan 60 are activated to maintain the temperature of the food product without overheating the oven casing or drying out the food. Controller 28 controls the lamps in response to output signals from temperature sensors 64 to maintain a predetermined temperature in the oven and thus the food product without causing further cooking. It will be appreciated by persons skilled in the art that the different radiant heating means may also be used together, with fan 60 providing the necessary cooling, without creating unwanted air flows in the oven chamber. Suitable commercially available temperature sensors can be selected by persons skilled in the art. The use of temperature sensors and averaged temperatures are well understood in the art, for example as taught in U.S. Pat. No. 4,782,445 to Pasquini.

Various combination modes are also contemplated wherein the first and second fans 38, 42, convection heating elements 30 and radiant heating elements 32, 34 are used together. In these modes it would not be necessary to use fan 60 because cooling air flows are provided by second fan 42. Also contemplated is a cool down mode wherein only third fan 60 is activated for a predetermined time.

During the various cooking and holding modes, controller 28 also communicates with motor 26 to control the rotational speed and on/off time for spit rotation. Spit rotation is controlled based on factors such as the food being cooked and the operational mode. The factors can be individually input by the operator through control pad 22 or can be preprogrammed as part of a preselected cooking cycle.

FIG. 8 illustrates a block diagram of a heat control system in accordance with the present invention. The controller 28 receives input signals from the control pad 22 over signal line 70. One or more temperature probes 64 provide signals to controller 28 indicating the temperature of the oven via signal line 72. A person of ordinary skill in the art can select a suitable timing device. Preferably, the timing device is provided integrally with controller 28. In addition, controller 28 receives timing information from timing device 74 over signal line 76. Output signals are provided by controller 28 to heating elements 30, 32, 34 over signal lines 78, 80, and 82, respectively. Controller 28 is further connected to provide output signals to convection fan motor 42 and cooling fan 60 over signal lines 84 and 86, respectively. Rotisserie motor 26 is controlled via signal line 88.

Controller 28 controls operation of heating elements 30, 32, 34 and fans 38, 44, 60 in various modes selected by an operator as described above via the control pad 22. Time durations for each mode may be entered by the user or pre-programmed, and elapsed time is monitored by timing device 74. Based on the input signal received via signal lines 70, 72 and 76, controller 28 operates the heating elements and fans in the convection mode, radiant heat mode, combination heat mode, or the cooling mode. In the convection heat mode, controller 28 activates convection heating elements 30 via signal line 78 and fan motor 42 over signal line 84 to drive convection fans 38, 44, thereby providing the convection air flow path illustrated by arrows 36 to effect convection cooking. In the radiant heat mode, controller 28 activates radiant heating elements 32 via signal line 80 and cooling fan 60 via signal line 86 to draw cooking air into the central channel 46. In the combination heat mode, both the convection and radiant heating elements 30, 32 as well as fan motor 42 are activated by controller 28 to provide both convection air flow and radiant heating. Lastly, in the cooling mode, cooling fan 60 is activated by the controller 28 over the signal line 86 to provide the cooling air flow previously described.

Those skilled in the art will appreciated that alternatively, the heating mode selection may be made automatically based on programmed information stored in memory associated with controller 28 when a key or keys representing a type of food product is selected by the user. Such information could be programmed by a user or by a manufacturer for various food products to be cooked in the rotisserie. The input signals from timing device 74 may further be used by controller 28 to activate a particular heating mode at a predetermined time during the cooking cycle. Controller 28 could also be coupled to a steam injection system (not shown) to control the injection of steam into the oven at predetermined times during the cooking process.

We claim:

1. An oven, comprising:

a cooking chamber for receiving food products to be cooked, defined by at least side walls and a top wall and bottom wall;

an outer casing surrounding said cooking chamber and spaced away from said chamber to define circulation passages between the chamber side and top walls and the casing;

first flow passage disposed within the cooking chamber and defined by said top wall and a cover secured thereto;

first fan means disposed within said first passage for drawing air therethrough and circulating air within the cooking chamber; and means disposed in said first passage for heating air passing therethrough;

wherein the top wall of the cooking chamber is substantially flat and substantially without seams in the area of the first air flow passage; and wherein said cover comprises at least two side walls and a bottom wall such that said cover in combination with said cooking chamber top wall defines a substantially rectangular cross-section for said first passage; and said cover is removably secured to said top wall; and said first fan means is removably mounted within said first passage as it may be removed for regular cleaning.

2. The oven according to claim 1, further comprising:

second air flow passage disposed above the cooking chamber communicating with the outside of the casing and said circulation passages; and second fan means disposed within said second passage for drawing air therein and circulating air through said circulation passages.

3. The oven according to claim 2, wherein said first and second fan means are mounted on a common shaft extending through the top wall of the cooking chamber and are driven by a first fan motor disposed in said second airflow passage, and said oven includes third fan means separately controllable from said first and second fan means, said third fan means being disposed to direct outside air into the second air flow passage for cooling said first fan motor and the oven casing without creating convection currents in the cooking chamber.

4. The oven according to claim 3, further comprising:

rotisserie means for carrying food products to be cooked;

means for rotating said rotisserie means;

radiant heating means mounted inside the cooking chamber, but outside the first flow passage;

operator interface means for allowing an operator to select between a plurality of operational modes, said modes including a) convection only mode wherein said first heating means and said first fan motor and first and second fan means are activated, b) radiant only mode wherein said radiant heating means and third fan means are activated, c) combination mode wherein said first and second fan means, said first heating means and said radiant heating means are activated, and d) cool down mode wherein only said third fan means is activated for a predetermined time; and control means responsive to said interface means for activating and controlling each said heating and fan component in accordance with the operator selected modes.

5. The oven according to claim 4, wherein:

said radiant heating means comprises at least one electric heating element and at least one quartz lamp, said lamp and element being separately controllable; and said radiant only mode comprises a holding mode wherein said heating means are controlled to maintain a predetermined temperature in the food product without further cooking and a searing mode wherein the heating means are controlled to cook the food product substantially by radiant heat alone.

6. The oven according to claim 5, wherein said rotisserie rotating means is controlled by said control means to provide predetermined rotation speeds and times in response to the selected operational mode and food product being cooked.

7. An oven, comprising:

a cooking chamber for receiving food products to be cooked, defined by at least side walls and top and bottom walls;

an outer casing surrounding said cooking chamber and spaced away from said chamber to define circulation passages between the chamber side and top walls and the casing;

first air flow passage disposed within the cooking chamber and defined by said top wall and a cover secured thereto;

first fan means disposed within said first passage for drawing air therethrough and circulating air within the cooking chamber;

first heating means disposed in said first passage for heating air passing therethrough;

second air flow passage disposed above the cooking chamber communicating with the outside of the casing and said circulation passages;

second fan means disposed within said second passage for drawing air therein and circulating air through said circulation passages;

first fan motor disposed in said second airflow passage for driving both said first and second fans means;

third fan means including a motor separately controllable from said first and second fan means, said third fan means being disposed to direct outside air into the second air flow passage for cooling said first fan motor and the oven casing without creating convection currents in the cooking chamber;

radiant heating means mounted inside the cooking chamber, but outside the first flow passage;

operator interface means for allowing an operator to select between a plurality of operational modes, said modes including a) convection only mode wherein said first heating means and said first fan motor and first and second fan means are activated, b) radiant only mode wherein said radiant heating means and third fan means are activated, and c) combination mode wherein said first and second fans means, said first heating means and said radiant heating means are activated; and control means responsive to said interface means for activating and controlling each said heating and fan component in accordance with the operator selected modes.

8. The oven according to claim 7, wherein:

the top wall of the cooking chamber is substantially flat and substantially without seams in the area of the first air flow passage;

said cover is secured to the top wall by removable fastening means such that the cover may be removed for regular cleaning, said cover comprising at least two side walls and a bottom wall such that the cover in combination with said cooking chamber top wall defines a substantially rectangular cross-section for said first passage; and said first fan means is removably mounted within said first passage such that it may be removed for regular cleaning.

9. The oven according to claim 7, wherein:

said radiant heating means comprises at least one electric heating element and at least one quartz lamp, said lamp and element being separately controllable; and said radiant only mode comprises a holding mode wherein said heating means are controlled to maintain a predetermined temperature in the food product without further cooking and a searing mode wherein the heating means are controlled to cook the food product substantially by radiant heat alone.

10. The oven according to claim 7, further comprising a rotisserie spit for carrying food and a motor for rotating said spit;

wherein said motor rotational speed and on and off times are provided by said control means in response to the selected operational mode.

11. An oven, comprising:

a cooking chamber for receiving food products to be cooked, defined by at least side walls and top and bottom walls;

an outer casing surrounding said cooking chamber and spaced away from said chamber to define circulation passages between the chamber side and top walls and the casing;

first air flow passage disposed within the cooking chamber and defined by said top wall and a cover secured thereto;

first fan means disposed within said first passage for drawing air therethrough and circulating air within the cooking chamber; and at least one convection heating element disposed in said first passage for heating air passing therethrough;

second air flow passage disposed above the cooking chamber communicating with the outside of the casing and said circulation passages;

second fan means disposed within said second passage for drawing air therein and circulating air through said circulation passages;

first fan motor disposed in said second airflow passage for driving both said first and second fan means;

third fan means including a motor separately controllable from said first and second fan means, said third fan means being disposed to direct outside air into the second air flow passage for cooing said first fan motor and the oven casing without creating convection currents in the cooking chamber;

at least one electric heating element disposed inside the cooking chamber, but outside said first flow passage for providing radiant heat on the food product;

at least one quartz lamp disposed in the cooking chamber, but outside said first flow passage;

operator interface means for allowing an operator to select between a plurality of predetermined operational modes, said modes including a) convection only mode wherein at least one said convection heating elements and said first fan motor and first and second fan means are activated, b) searing mode wherein said radiant electric heating element and third fan means are activated and said heating element is controlled to cook the food product substantially by radiant heat alone, c) holding mode wherein said lamp and said third fan means are activated and said lamp is controlled to maintain a predetermined temperature in the food product without further cooking, and d) combination mode wherein said first and second fan means, said at least one convection heating element and said at least one radiant heating element or quartz lamp are activated; and control means responsive to said interface means for activating and controlling each said heating and fan component in accordance with the operator selected modes.

12. The oven according to claim 11 wherein:

the top wall of the cooking chamber is substantially flat and substantially without seams in the area of the first air flow passage;

said cover is removable and comprises at least two side walls and a bottom wall such that said cover in combination with said cooking chamber top wall defines a substantially rectangular cross-section for said first passage; and said first fan means is removably mounted within said first passage such that it may be removed for regular cleaning.

13. The oven according to claim 11, further comprising a rotisserie spit for carrying food and a motor for rotating said spit;

wherein said motor rotational speed and on and off times are provided by said control means in response to the selected operational mode.

14. An oven, comprising:

a cooking chamber for receiving food products to be cooked, defined by at least side walls and a top wall and bottom wall;

an outer casing surrounding said cooking chamber and spaced away from said chamber to define circulation passages between the chamber side and top walls and the casing;

first air flow passage disposed within the cooking chamber and defined by said top wall and one of at least first and second removable covers, both said covers having vents for entry and exit of air and being adapted to be secured to the top wall of the cooking chamber by removable fastening means to define the first airflow passage wherein said covers are provided with different vent configurations such that air passes more quickly through one said cover;

first fan means disposed within said first passage for drawing air therethrough and circulating air within the cooking chamber; and means disposed in said first passage for heating air passing therethrough.

* * * * *